US006382352B1

(12) United States Patent
Dowe, Sr.

(10) Patent No.: US 6,382,352 B1
(45) Date of Patent: May 7, 2002

(54) DEPLOYABLE EMERGENCY ESCAPE LADDER

(76) Inventor: Alfonzo Dowe, Sr., 126 Perkintown Rd., Pedricktown, NJ (US) 08067

( * ) Notice: Subject to any disclaimer, the term of this patent is extended or adjusted under 35 U.S.C. 154(b) by 0 days.

(21) Appl. No.: 09/761,257

(22) Filed: Jan. 16, 2001

(51) Int. Cl.[7] ..... A62B 1/06; E06C 1/52
(52) U.S. Cl. ..... 182/70; 182/196
(58) Field of Search ..... 182/70, 76, 206, 182/196, 197, 198

(56) References Cited

U.S. PATENT DOCUMENTS

| | | | | | |
|---|---|---|---|---|---|
| 458,023 | A | * | 8/1891 | Kimball et al. | 182/70 |
| 632,226 | A | * | 8/1899 | Menges | 182/70 X |
| 3,677,366 | A | | 7/1972 | Loeffel | |
| 3,946,834 | A | | 3/1976 | Shafer et al. | |
| 4,127,184 | A | | 11/1978 | Strohmeyer | |
| 4,381,046 | A | | 4/1983 | Landem | |
| 4,401,183 | A | | 8/1983 | Schler | |
| 4,702,347 | A | | 10/1987 | Nilsen | |
| 5,020,633 | A | | 6/1991 | Rangel | |
| 5,022,491 | A | | 6/1991 | Gill | |
| 5,060,753 | A | * | 10/1991 | Hopkins | 182/70 X |
| 5,076,394 | A | | 12/1991 | Sheu | |
| 5,746,287 | A | * | 5/1998 | Durham, Jr. | 182/70 |
| 5,752,459 | A | * | 5/1998 | Rexroad | 182/196 X |
| 5,871,067 | A | | 2/1999 | Parenti | |
| 6,015,027 | A | * | 1/2000 | Banks | 182/70 |
| 6,029,771 | A | * | 2/2000 | Keown | 182/196 X |
| 6,169,908 | B1 | * | 8/2001 | Yeamans et al. | 182/196 |

* cited by examiner

*Primary Examiner*—Daniel P. Stodola
*Assistant Examiner*—Hugh B. Thompson
(74) *Attorney, Agent, or Firm*—John D. Gugliotta; P. Jeff Martin

(57) ABSTRACT

A deployable emergency escape ladder is provided that permits rapid egress from the upper floors of a building or home in the event of a fire. A canvas pouch is located directly below the interior sill of a second story or higher window. The pouch is fastened securely via a metal back plate that penetrates through the rear of the pouch and fastens to the wall. Connected to this metal plate and rolled up inside the pouch is a KEVLAR® rope ladder with PVC runs with the exception of the bottom rung which is made of weighted aluminum. This weighted lowest step allows the invention to unroll and hang on the exterior of the building in a secure fashion without swaying.

8 Claims, 2 Drawing Sheets

DEPLOYABLE EMERGENCY ESCAPE LADDER

RELATED APPLICATIONS

The present invention was first described in Disclosure Document No. 479,758 filed on Sep. 14, 2000. There are no previously filed, nor currently any co-pending applications, anywhere in the world.

BACKGROUND OF THE INVENTION

1. Field of the Invention

The present invention relates generally to fire escape ladders and, more particularly, to a deployable emergency escape ladder.

2. Description of the Related Art

As any homeowner will attest, security is an area of primary concern. Due to the fact that people tend to place a high value on their property and personal safety, the marketplace has responded with a variety of products that are intended to protect one's life and property. One product that has seen wide use is the emergency escape ladder used on two or three story homes and buildings. This chain ladder is unrolled from the window and the person climbs down to safety. While this process sounds easy, there are several steps involved with this process. First, the ladder must be retrieved from its storage location. Second, it must be hooked to the window sill, hopefully in a secure fashion. Finally, the ladder must be unrolled, hopefully in an untangled manner. Additionally, it must be remembered that all of these steps are occurring under an emergency situation, where smoke, darkness, fear, unfamiliar surroundings and the like may be present.

Accordingly, there exists a need for a means by which people can quickly and safely exit a multilevel home or building under an emergency situation without the difficulties associated with current methods. The development of the deployable emergency escape ladder fulfills this need.

A search of the prior art did not disclose any patents that read directly on the claims of the instant invention; however, the following references were considered related.

The following patents disclose a collapsible fire escape ladder pivotally mounted to a window sill: U.S. Pat. No. 5,871,067 issued in the name of Parenti; and U.S. Pat. No. 5,022,491 issued in the name of Gill.

The following patents describe a fire escape ladder storage and deployment device stored on the wall: U.S. Pat. No. 5,076,394 issued in the name of Sheu; U.S. Pat. No. 5,020,633 issued in the name of Rangel; U.S. Pat. No. 4,381,046 issued in the name of Landem; and U.S. Pat. No. 3,677,366 issued in the name of Loeffel.

U.S. Pat. No. 4,702,347 issued in the name of Nilsen discloses a folding, burglarproof fire escape ladder.

U.S. Pat. No. 4,401,183 issued in the name of Schier describes a high rise fire escape ladder mounted on the parapet.

U.S. Pat. No. 4,127,184 issued in the name of Strohmeyer discloses a combination plant box and fire escape ladder.

U.S. Pat. No. 3,946,834 issued in the name of Shafer et al. describes a self-storing fire escape ladder with a carrying handle.

Consequently, a need has been felt for providing a device which provides a means of safe egress from the upper floors of a building in the event of a fire that can be quickly deployed by anyone in a manner which is safe, quick and effective.

SUMMARY OF THE INVENTION

Therefore, it is an object of the present invention to provide an emergency escape ladder which is used on multilevel homes or buildings.

It is another object of the present invention to provide an emergency escape ladder which allows rapid egress from structures in the event of fire or other emergency.

It is another object of the present invention to provide an emergency escape ladder which is easily used and deployed with little or no training.

It is another object of the present invention to provide an emergency escape ladder which saves lives.

It is another object of the present invention to provide an emergency escape ladder which can be used in case of fire, burglary, carbon monoxide, etc.

It is another object of the present invention to provide an emergency escape ladder comprised of KEVLAR® rope and lightweight PVC rungs.

It is another object of the present invention to provide a weighted bottom step made of aluminum or other heavier material.

It is another object of the present invention to provide a weighted bottom step which allows the escape ladder to unroll smoothly and keeps the escape ladder from swaying.

It is another object of the present invention to provide a weighted bottom step which makes the escape ladder easier to climb down.

It is another object of the present invention to provide a canvas pouch which stores the escape ladder in place directly below a window sill.

It is another object of the present invention to provide a canvas pouch which is permanently fastened in position by metal plate and mounting hardware.

It is another object of the present invention to provide a canvas pouch which utilizes an easy-open zipper.

It is another object of the present invention to provide a canvas pouch which always keeps the escape ladder handy and untangled.

It is another object of the present invention to provide a canvas pouch available in multiple colors and styles which allows easy blending into any decor.

Briefly described according to one embodiment of the present invention, a deployable emergency escape ladder permits rapid egress from the upper floors of a building or home in the event of a fire. The invention takes the form of a canvas pouch that is located directly below the interior sill of a second story or higher window. The pouch is fastened securely via a metal back plate that penetrates through the rear of the pouch and fastens to the wall. Connected to this metal plate and rolled up inside the pouch is a KEVLAR® rope ladder with PVC rungs with the exception of the bottom rung which is made of weighted aluminum. This weighted lowest step allows the invention to unroll and hang on the exterior of the building in a secure fashion without swaying.

The use of the deployable emergency escape ladder provides a means of safe egress from the upper floors of a building in the event of a fire that can be quickly deployed by anyone in a manner which is safe, quick and effective.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
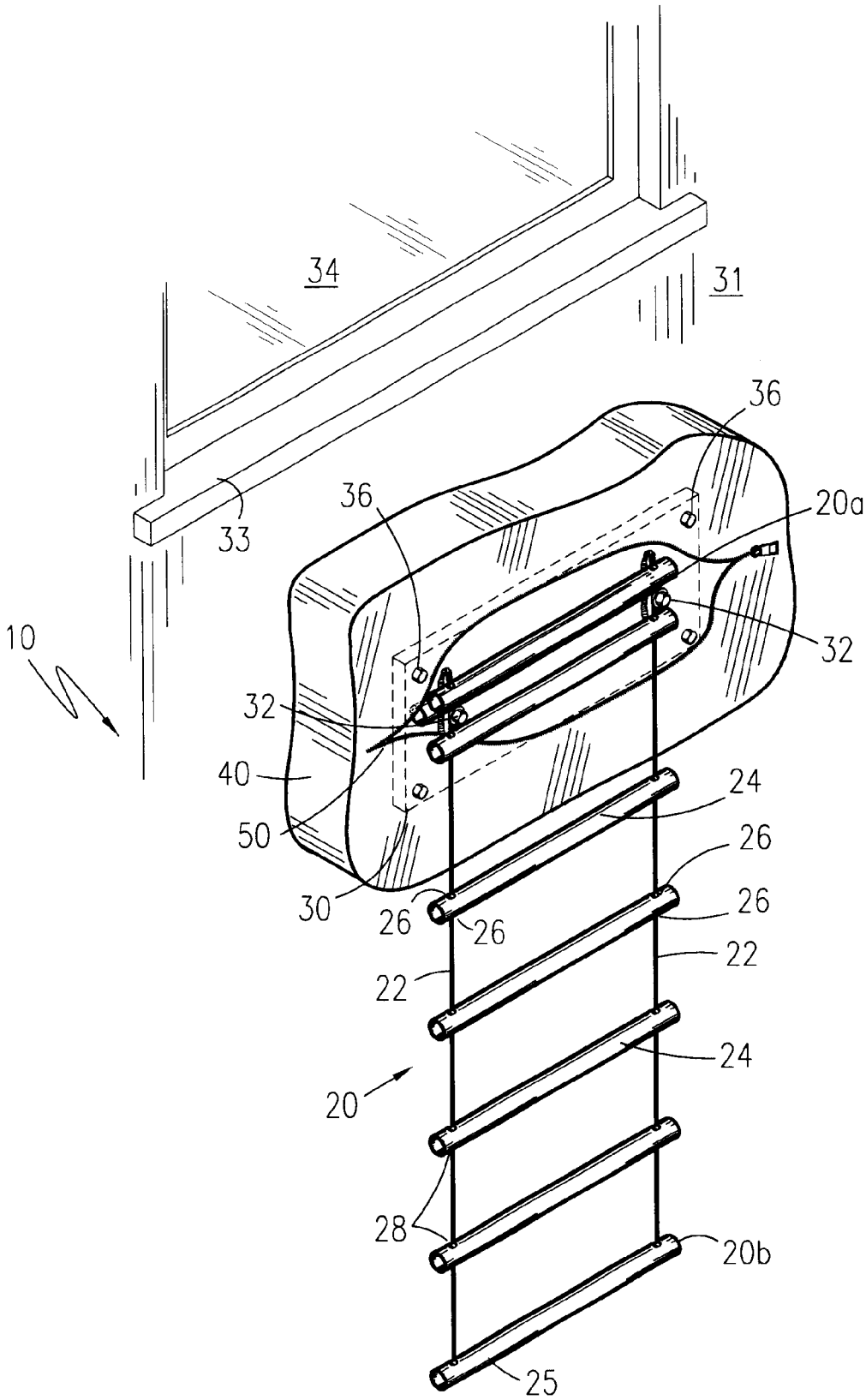
FIG. 1 is a perspective view of a deployable emergency escape ladder according to the preferred embodiment of the present invention.
Figure 2:
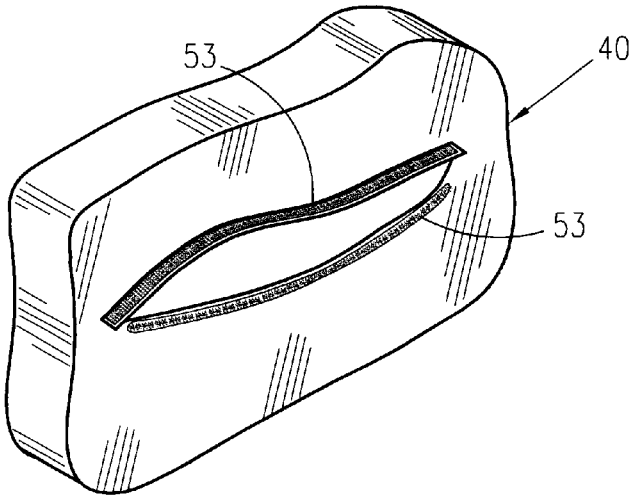
FIG. 2 is a side elevational view of the canvas pouch shown with Velcro® material according to the preferred embodiment of the present invention.
Figure 3:
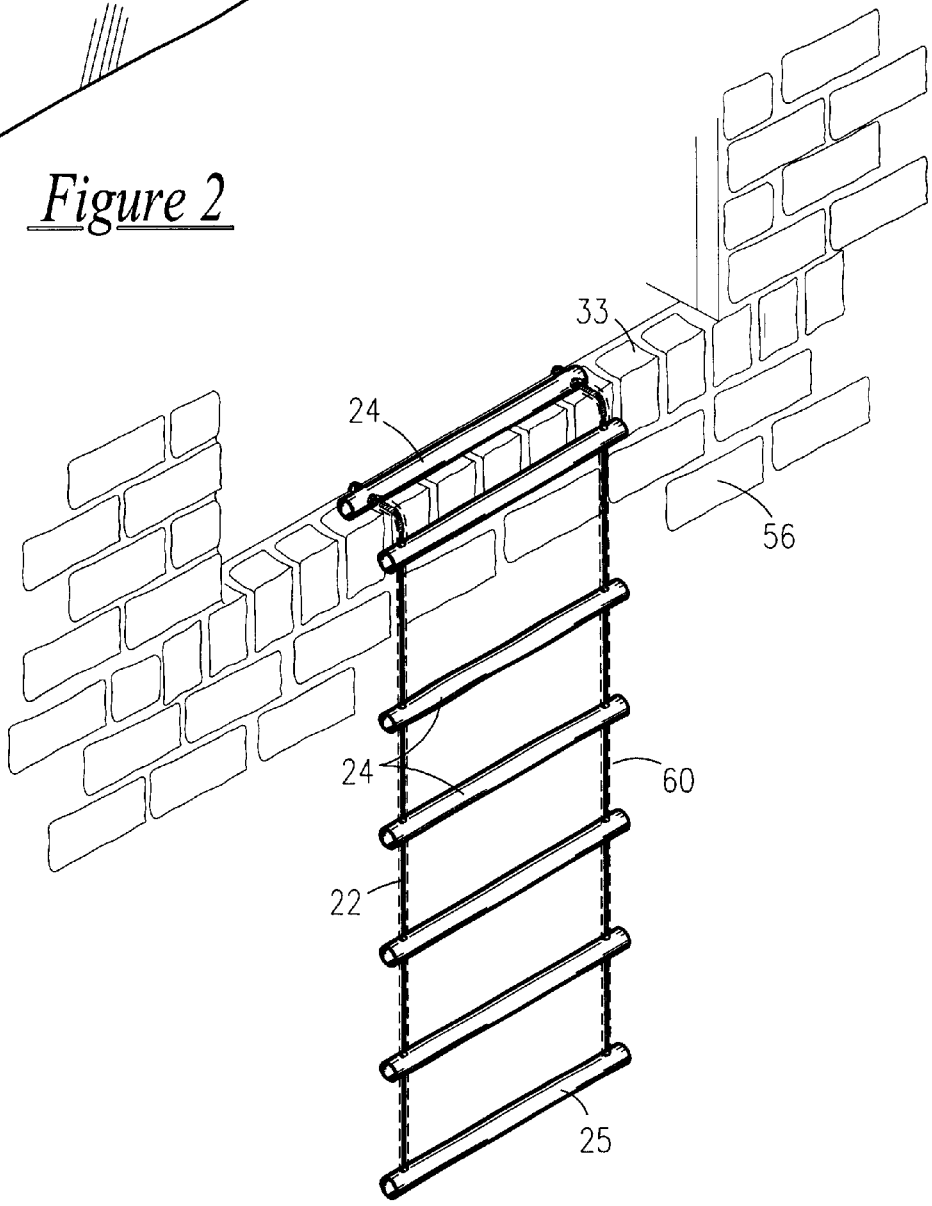
FIG. 3 is a perspective view of the escape ladder shown deployed over a window sill and extending down an outside building wall.

Referring now to FIGS. 1–3, a flexible, lightweight, fire-retardant, deployable emergency escape ladder 10 is shown, according to the present invention, comprised of an escape ladder 20, a wall mounting bracket 30, and a canvas pouch 40. The escape ladder 20 has an anterior end 20*a* opposite a posterior end 20*b* and is comprised of paired. elongated, flexible, roped ladder uprights 22 fabricated of a high strength durable synthetic fiber material selected from a member of the group consisting of nylon, polyester, polypropylene, and KEVLAR® brand fiber. The ladder uprights 22 have a plurality of ladder rungs 24 horizontally disposed therebetween. Each ladder rung 24 is of a linearly elongated, cylindrical, hollow configuration constructed of polyvinyl chloride material and has a rope receiving hole 26 formed at opposing ends thereof, wherein each hole 26 is designed to receive each of the pair of the flexible ladder uprights 22 therethrough. The ladder uprights 22 are knotted along various linear sections thereof, wherein each knot 28 is positioned above and below each rope receiving hole 26 of each ladder rung 24, thereby securing the ladder rungs 24 to the ladder uprights 22. It is envisioned that each ladder rung 24 is of a length measuring approximately 15 inches, and each sequentially aligned, horizontally disposed ladder rung 24 is separated by a vertical distance measuring approximately 12 inches.

The anterior end 20*a* of the escape ladder 20 is mounted to a wall mounting bracket 30 via bolts 32. The wall mounting bracket 30 is of a flat, rectangular configuration fabricated of steel, and is mounted to an inside wall 31 below a windowsill 33 of a window 34 of a second floor or higher of a home, apartment building, hotel, school, or other building via bolts 36.

The inside wall is of a suitable strength so as to supply sufficient anchorage of the deployable emergency escape ladder 10 coupled with body weight of an escapee thereon.

It is envisioned that the dimensions of the wall mounting bracket 30, ladder rungs 24, and ladder uprights 22 are suitably varied so as to accommodate windows of various sizes and to accommodate a plurality of floors within multilevel buildings.

The posterior end 20*b* of the escape ladder 20 includes a rigid, elongated, weighted lower aluminum ladder rung 25 secured to the ladder uprights 22 via knots 28 positioned above and below rope receiving holes 26 formed at opposed ends of ladder rung 25.

It is envisioned that ladder rung 25 is of a length measuring approximately 15 inches.

The escape ladder 20 is designed and configured so as to be rolled up and housed within a canvas pouch 40, until being deployed and unrolled therefrom in the event of a fire or other emergency requiring escape through the window 34.

The canvas pouch 40 is fabricated of a flame-retardant material and is fastened to a front surface of the wall mounting bracket 30. The canvas pouch 40 is of a size suitable for concealing the bracket 30 therebehind. The canvas pouch 40 is designed to blend aesthetically with decor of the window 34 and the inside building wall 31. The canvas pouch 40 is opened and closed via a zipper 50 sewn horizontally along an outer surface thereof. It is envisioned that other suitable means for opening and closing the canvas pouch 40 such as VELCRO® material 53 are provided for allowing simple, easy, and quick access to the escape ladder 20.

In the event of a fire or other emergency, the canvas pouch 40 is opened via the zipper 50, wherein the escape ladder 20 is unrolled therefrom, extended over the windowsill 33, and down an outside building wall 56. Being weighted, the aluminum ladder rung 25 facilitates unrolling of the escape ladder 20 in an untangled manner adjacent to the outside building wall. The weighted aluminum ladder rung 25 prevents lateral, sweeping movement of the escape ladder 20 when deployed from the window.

In order to ensure tangle-free unrolling and easier handling of the escape ladder 20 when deployed, it is envisioned that fifty pound, brown, craft paper 60 is pre-rolled therewith. As the escape ladder 20 deploys, the craft paper 60 is shed therefrom and falls to ground.

2. Operation of the Preferred Embodiment

To use the present invention, in the event of a fire or other emergency requiring escape through the window, the user opens the canvas pouch 40 via the zipper 50 and simply unrolls the escape ladder 20 therefrom extending it over the windowsill 33 adjacent to and down an outside building wall 56. The user then simply climbs down to safety via the ladder rungs 24, 25 of the escape ladder 20.

The use of the present invention provides a means of safe egress from the upper floors of a building in the event of a fire that can be quickly deployed by anyone in a manner which is safe, quick and effective.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. Therefore, the scope of the invention is to be broadly limited only by the following claims.

What is claimed is:

1. An emergency escape ladder comprising:

a wall mounting bracket of a flat, rectangular configuration for mounting to an inside wall below a windowsill of a window via bolts;

a canvas pouch having an opening in a front face thereof, and being affixed to said wall mounting bracket; and a ladder attached to said wall mounting bracket and having an anterior end opposite a posterior end and having a paired, elongated, flexible, roped ladder uprights with a plurality of ladder rungs horizontally disposed therebetween; wherein said ladder is retained within said canvas pouch until deployed through said opening.

2. The emergency escape ladder of claim 1, wherein each said ladder rung comprises a linearly elongated, cylindrical hollow configuration constructed of polyvinyl chloride material and has a rope receiving hole formed at opposing ends thereof, wherein each said hole is designed to receive each of the pair of the flexible ladder uprights therethrough.

3. The emergency escape ladder of claim 2, wherein said ladder uprights are knotted along various linear sections thereof, wherein each knot is positioned above and below each rope receiving hole of each ladder rung, thereby securing said ladder rungs to said ladder uprights.

4. The emergency escape ladder of claim 3, wherein said posterior end of said escape ladder further comprises a rigid, elongated, weighted lower ladder rung secured to said ladder uprights via knots positioned above and below said rope receiving holes formed at opposed ends of said ladder rung.

5. The emergency escape ladder of claim 2, wherein each said ladder rung is of a length measuring approximately 15 inches, and each sequentially aligned, horizontally disposed ladder rung is separated by a vertical distance measuring approximately 12 inches.

6. The emergency escape ladder of claim 1, wherein said ladder is designed and configured so as to be rolled up and housed within said canvas pouch until being deployed and unrolled therefrom in the event of a fire or other emergency requiring escape through a window.

7. The emergency escape ladder of claim 1, wherein said canvas pouch is fabricated of a flame-retardant material.

8. The emergency escape ladder of claim 1, wherein said ladder is fabricated of a high-strength durable synthetic fiber material.

* * * * *